US007463114B2

(12) United States Patent
Teh et al.

(10) Patent No.: US 7,463,114 B2
(45) Date of Patent: Dec. 9, 2008

(54) RADIO FREQUENCY ASSEMBLY AND A MULTIPORT SWITCH HAVING THE SAME

(75) Inventors: Chee Leong Teh, Penang (MY); Kim Yen Ang, Penang (MY)

(73) Assignee: Agilent Technologies, Inc., Santa Clara, CA (US)

( * ) Notice: Subject to any disclaimer, the term of this patent is extended or adjusted under 35 U.S.C. 154(b) by 149 days.

(21) Appl. No.: 11/623,757

(22) Filed: Jan. 17, 2007

(65) Prior Publication Data

US 2008/0169881 A1 Jul. 17, 2008

(51) Int. Cl.
*H01P 1/10* (2006.01)
*H01P 5/12* (2006.01)

(52) U.S. Cl. ..... 333/105; 333/101; 333/262

(58) Field of Classification Search ..... 333/101, 333/105, 107, 262
See application file for complete search history.

(56) References Cited

U.S. PATENT DOCUMENTS

| | | | | |
|---|---|---|---|---|
| 4,697,056 | A * | 9/1987 | Hoffman | 200/504 |
| 5,451,918 | A | 9/1995 | Sun | |
| 2004/0113714 | A1 * | 6/2004 | Kwiatkowski et al. | 333/105 |

* cited by examiner

*Primary Examiner*—Anh Q Tran
(74) *Attorney, Agent, or Firm*—Marc Bobys

(57) ABSTRACT

An RF assembly of a multiport switch is disclosed. The RF assembly includes an RF cavity housing and a cover. The RF cavity housing includes a common port defined by a cavity in a surface of the RF cavity housing and at least another port defined by a trough in the surface of the RF cavity housing. The trough is connected to the cavity. When covered by the cover, the trough defines a channel connected at one end to the cavity. The distance between opposing surfaces of the RF cavity housing and the cover at a proximal end of the channel is smaller than the corresponding distance of a portion of the channel immediately adjacent the proximal end. A multiport switch having the RF assembly is also disclosed.

20 Claims, 6 Drawing Sheets

RADIO FREQUENCY ASSEMBLY AND A MULTIPORT SWITCH HAVING THE SAME

BACKGROUND

A multiport switch is a mechanical switch used to alter the path of an incoming signal at an input to one of several outputs, or to select one of several inputs for an output. Existing multiport switches operate up to a frequency of around 26.5 GHz. FIG. 1 shows an RF cavity housing 100 of a known single-pole-six-throw (SP6T) coaxial multiport switch (not shown). The RF cavity housing 100 has a starlike-shaped RF cavity 102 in a surface 104. The RF cavity 102 includes a central cavity 106 that defines a common port of the multiport switch. This central cavity 106 receives a centre pin of an RF connector (not shown). The RF cavity 102 also includes six troughs 108 that define six outer (individual) ports of the multiport switch. Each trough 108 receives the centre pin of a respective RF connector. The trough 108 is connected, at its proximal end 110, to the central cavity 106 to allow the centre pins in the trough 108 and the central cavity 106 to be electrically connected via a switch blade (reed) in a closed state of that port. At the distal end 112 of each trough 108 is a terminating load card to which the centre pin in the trough 108 is connected when in an open state of the port.

When covered using a cover (not shown), the trough 108 defines a channel with its proximal end connected to the central cavity 104. The width of the trough 108, and thus the channel, reduces at the proximal end 110 of the trough 108 towards the central cavity 106. The height of the channel at the proximal end 110 is equal to the height of a portion 114 of the channel immediately adjacent the proximal end 110. That is, the distance between opposing surfaces of the RF cavity housing 100 and the cover at the proximal end 110 is the same as the corresponding distance at the channel portion 114 immediately adjacent the proximal end 110.

Multiport switches having the above described RF cavity 102 are able to operate up to frequencies around 26.5 GHz. Examples of multiport switches having such an RF cavity 102 are two products (part numbers R594F73627 and R574F53400 respectively) from the microwave component manufacturer Radiall SA. However, military, aerospace and space environment applications require a multiport switch that is able to operate at frequencies higher than 26.5 GHz, for example, in the frequency range of 40-50 GHz.

SUMMARY

The invention may be implemented as an RF assembly of a multiport switch. The RF assembly includes an RF cavity housing and a cover for covering the RF cavity housing. The RF cavity housing includes a common port defined by a cavity in a surface of the RF cavity housing. The RF cavity housing further includes at least another port defined by a trough in the surface of the RF cavity housing. The trough is connected to the cavity. When covered using the cover, the trough defines a channel. A proximal end of the channel is connected to the cavity. The distance between opposing surfaces of the RF cavity housing and the cover at the proximal end of the channel is smaller than the distance between opposing surfaces of the RF cavity housing and the cover at a portion of the channel immediately adjacent the proximal end.

The invention may also be implemented as a multiport switch including the above described RF assembly.

Other aspects and advantages of the invention will become apparent from the following detailed description, taken in conjunction with the accompanying drawings, illustrating by way of example the principles of the invention.

BRIEF DESCRIPTION OF DRAWINGS

The invention will be better understood with reference to the drawings, in which.

DETAILED DESCRIPTION OF THE EMBODIMENTS

Figure 1:
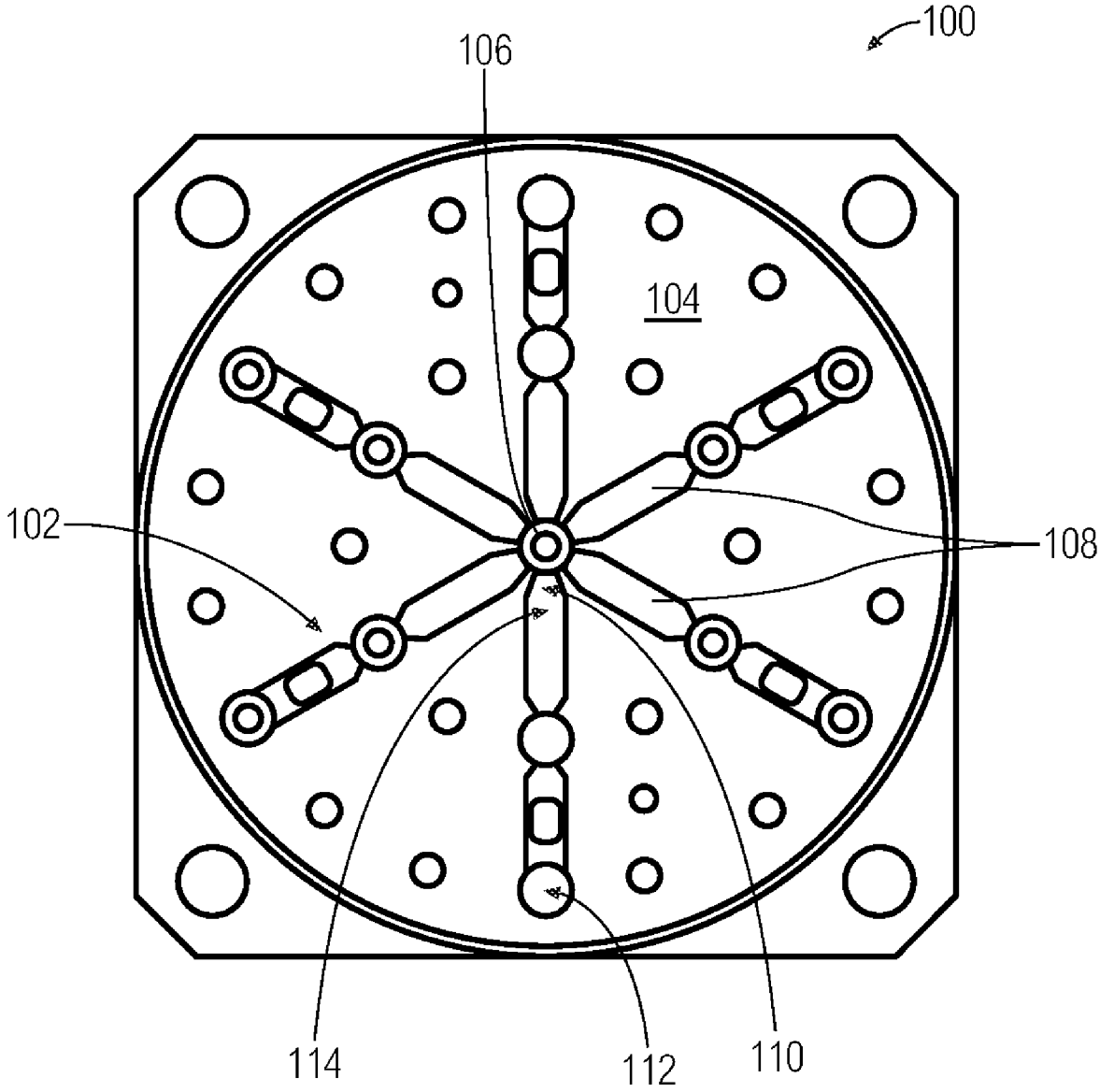
FIG. 1 (PRIOR ART)
FIG. 1 is a plan view of a prior art RF cavity housing having six troughs.
Figure 2:
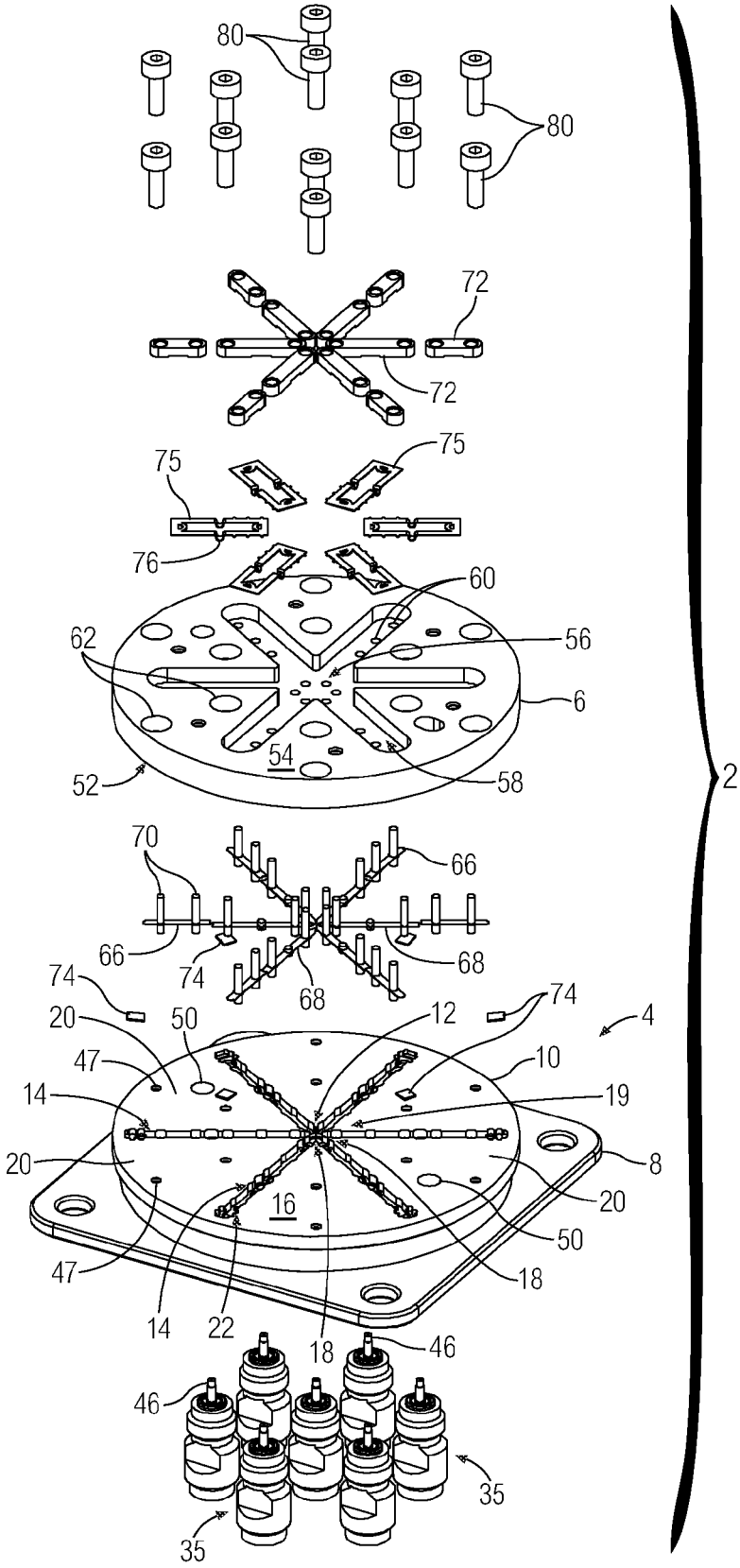
FIG. 2 is an exploded isometric drawing of an RF assembly of a multiport switch according to an embodiment of the invention, the RF assembly having an RF cavity housing and a cover.

As shown in the drawings for purposes of illustration, the invention may be embodied in a novel RF assembly that is able to operate beyond 26.5 GHz. Existing RF assemblies are able to operate up to frequencies of only around 26.5 GHz. Referring to FIGS. 2 to 5, an RF assembly embodying the invention generally includes an RF cavity housing and a cover for covering the RF cavity housing. The RF cavity housing includes a common port defined by a cavity in a surface of the RF cavity housing. The RF cavity housing further includes at least another port defined by a trough in the surface of the RF cavity housing. The trough is connected to the cavity. When covered using the cover, the trough defines a channel in the RF assembly that is connected at its proximal end to the covered cavity. The height of the channel, defined by the distance between opposing surfaces of the RF cavity housing and the cover, at the proximal end of the channel is smaller than the height of a portion of the channel immediately adjacent the proximal end.

Figure 4:
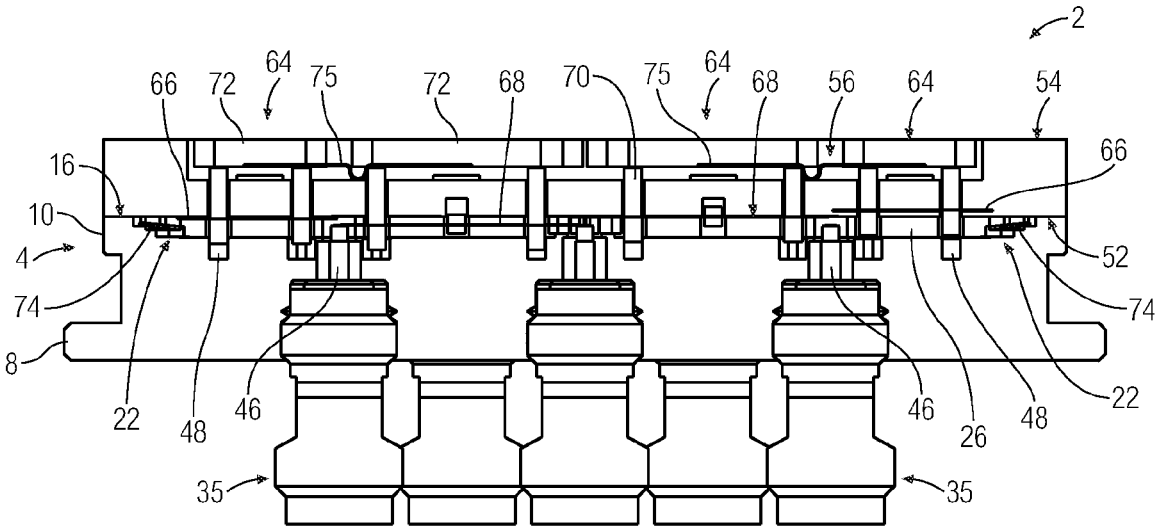
FIG. 4 is a sectional drawing of the RF assembly in FIG. 3 viewed in the direction of arrow X in FIG. 3.
Figure 5:
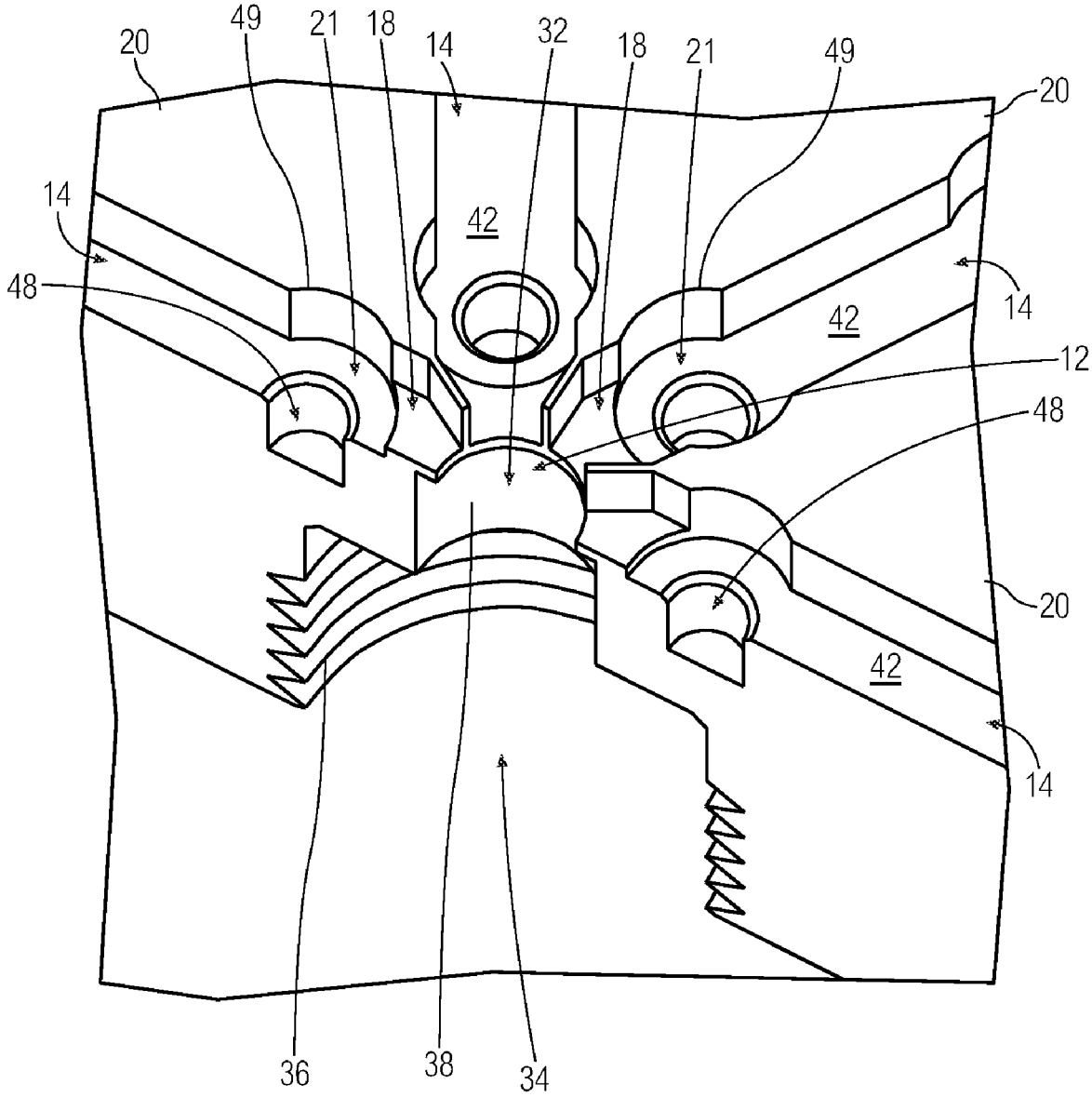
FIG. 5 is an enlarged sectional isometric drawing of the RF cavity housing in FIG. 2.
Figure 6A:
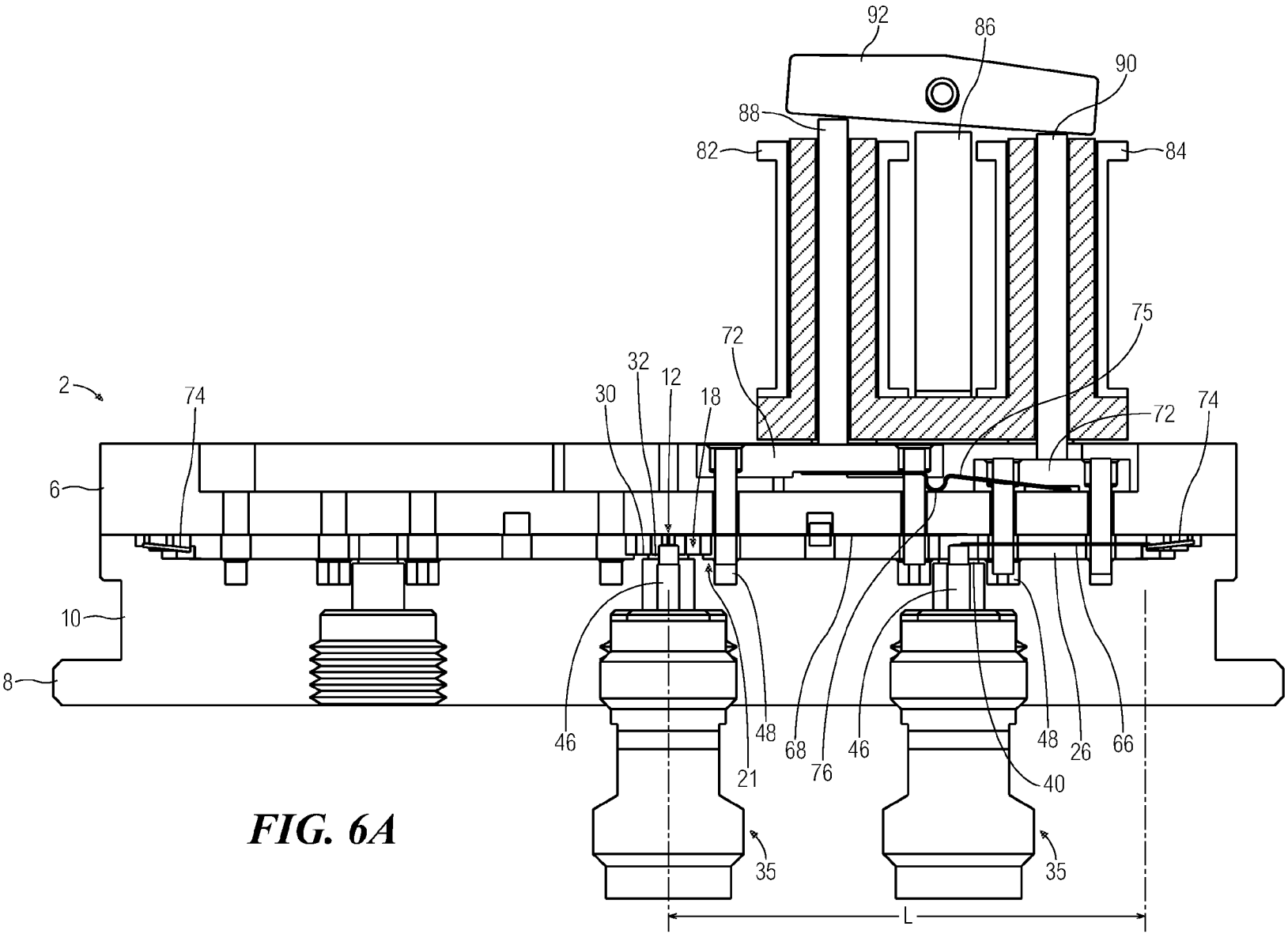
FIG. 6A is a schematic drawing of a section of a drive assembly shown connected to a port of the RF assembly in FIG. 5, the drive assembly section being in an non-actuated state.
Figure 6B:
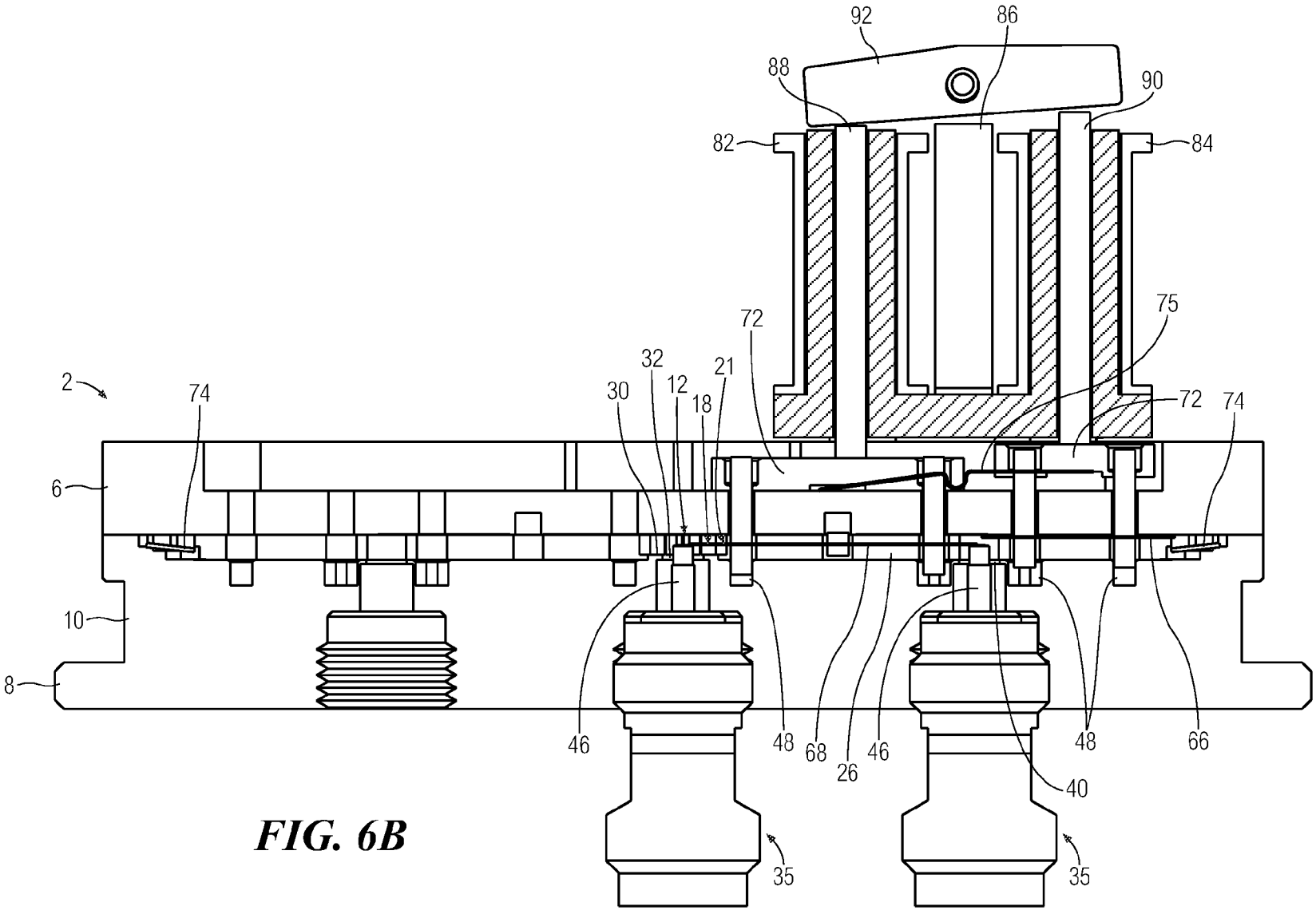
FIG. 6B is a schematic drawing similar to FIG. 6A showing the drive assembly section in an actuated state to put the port in a closed state.

Specifically, FIG. 2-5 show the above described RF assembly 2 that is used in a single-pole-six-throw (SP6T) multiport switch. In addition to the RF assembly 2, the multiport switch includes an interface board (not shown), a sensor board assembly (not shown) and a drive assembly 5 (partially shown in FIGS. 6A and 6B), all of which are known to those skilled in the art. The power for driving the multiport switch is supplied to the drive assembly 5 via the interface board and the sensor board assembly. External control signals for controlling the drive assembly 5 are also routed thereto via the interface board and the sensor board assembly. The sensor board assembly includes an electronic circuit for detecting when the multiport switch is fully latched during switching. This electronic circuit will cut off power to the drive assembly when it senses that the multiport switch is fully latched. Such an action is necessary to prevent damage to the drive assembly due to excessive current flowing through its solenoids 82, 84 (FIGS. 6A and 6B). The drive assembly and its operation will be described in more detail shortly.

Referring once again to FIG. 2, the RF assembly 2 includes the RF cavity housing 4 and the cover 6 for covering the RF cavity housing 4 that are briefly described above. The RF cavity housing 4 includes a square lower housing body 8 and a circular upper housing body 10 integral with the lower housing body 8. In other words, the upper housing body 10 and the lower housing body 8 are of a monolithic design. The RF cavity housing 4 and the cover 6 are made of aluminum alloy 6061-T6. The upper housing body 10 includes a central cavity 12 and six troughs 14 in a surface 16 thereof. Each of the six troughs 14 is connected at its proximal end 18 (FIG. 5) to the central cavity 12. The six troughs 14 radiate outwards from the central cavity 12 to define an asterisk or starlike-shaped RF cavity 19. The central cavity 12 defines a common port and each trough 14 defines an outer (individual) port connected to the common port. During use, an input signal at the common port may be channeled or switched to any one of the six individual ports. Alternatively, it is possible to switch one of several, up to six in this embodiment, input signals at the individual ports to the common port.

The surface 16 of the upper housing body 10 is machined, such as by milling, to remove certain portions thereof and to leave other non-machined sectoral portions 20 so as to define the central cavity 12 and the troughs 14 connected to the central cavity 12. Two sectoral portions 20 thus flank each trough 14 to define its side walls or boundaries. When viewed from the top, each trough 14 may have a length L (FIG. 6A), measured from a centre of the RF cavity housing to an edge of a 50-ohm terminating load card 74 facing the trough 14, in the range of 21.716 mm-22.716 mm. The terminating load card 74 is located at a distal end 22 of the trough 14. Each trough 14 may have a width in the range of 1.108 mm-2.108 mm and a height in the range of 0.643 mm-1.337 mm for almost the entire length of the trough 14 including a portion 21 (FIG. 5) of the trough 14 immediately adjacent the proximal end 18. The height of the trough 14 or channel 26 when covered by the cover 6 is given by the distance between opposing surfaces of the RF cavity housing 4 and the cover 6 that define the channel 26. The height of a portion of the channel 26 may thus be reduced by having one of the surfaces closer to the other. The width of the trough reduces, at its proximal end 18 towards the central cavity 12, to a value in the range of 0.337 mm-1.337 mm where the proximal end 18 meets the central cavity 12. In other words, the proximal end 18 of the trough 14 tapers off toward the central cavity 12. The two sectoral portions 20 flanking each trough 14 include respective ribs 24 that define the proximal end 18 of the trough 14. In one specific embodiment, the length L of the trough 14 is 22.216 mm, the width along the length of the trough is 1.608 mm and at the proximal end where it connects to the central cavity 12 is 0.837 mm, and the height of the portion 21 of the trough immediately adjacent the proximal end 18 is 1.143 mm and at the proximal end 18 where it meets the central cavity 12 is 0.918 mm. These specific dimensions are determined using the HFSS software (a trademarked industry-standard software for S-parameter and full-wave SPICE extraction and for the electromagnetic simulation of high-frequency and high-speed components from Ansoft Corporation) to result in an RF assembly 2 that is able to operate at frequencies beyond 26.5 GHz. Other combination of values in the ranges may be similarly obtained using the HFSS software.

The upper housing body 10 is also machined to leave a platform 30 (FIG. 5) at in the RF cavity 19. This platform 30 is 0.225 mm thick and is located in the central cavity 12 and the proximal ends 18 of the troughs 14, to reduce the height of the channels 26 thereat. The thickness of the platform 30 may be in the range of 0.05 mm-0.40 mm. The platform 30 includes an opening 32 of a diameter in the range of 1.35 mm-2.35 mm. In the specific embodiment, the diameter of the platform opening is 1.85 mm. Each trough 14 is thus of a non-uniform height around the proximal end 18, with the height reduced at the proximal end 18. As shown in FIG. 5, the reduced width and height at this proximal end 18 of the trough defines a constriction of the channel 26.

Seven bores 34 (one of which is shown in FIG. 5) for receiving respective RF connectors 35 extend through the lower housing body 8 to be connected to the respective ports of the RF cavity 19. Each bore 34 has a threaded section 36 in axial alignment with an unthreaded section 38. The unthreaded section 38 opens into the RF cavity 19. In the case of the common port, the bore 34 is connected to the central cavity 12 via the platform opening 32. For the outer or individual ports, the bore 34 opens into the RF cavity 19 via an opening 40 in the floor 42 of the troughs 14. The respective portions of the platform 30 and the floor 42 that define the openings 32, 40 thus overhang the respective bores 34. The unthreaded section 38 is of a smaller diameter than the threaded section 36. This smaller diameter may be in the range of 1.9 mm-2.9 mm. In the specific embodiment, this smaller diameter is 2.4 mm. The diameter of the floor opening 40 is in the range of 1.9 mm-2.9 mm. In the specific embodiment, the diameter of the floor opening 40 is 2.4 mm. When an RF connector 35 is inserted into the bore 34, only a centre pin 46 of the RF connector 35 protrudes into the RF cavity 19 via the platform opening 32 or the floor opening 40. The tip of the centre pin 46 has a diameter in the range of 0.415 mm-1.415 mm. In the specific embodiment, the diameter of the centre pin 46 is 0.915 mm.

The unthreaded section 38 of the bores 34 does not terminate at the level of the floor 42 or the platform surface in the RF cavity 19. Instead, the unthreaded section 38 terminates at a position adjacent or offset from the floor level and the platform surface in the RF cavity 19. Thickness of the floor portion that overhangs the bore 34 is in the range of 0.1 mm-0.325 mm. In the specific embodiment, the thickness of the floor portion is 0.225 mm.

The upper housing body 10 also includes twelve threaded apertures 47 in the external surface 16 thereof which are used for attaching the cover 6 to the RF cavity housing 4. The floor 42 of the upper housing body 10 is drilled to create multiple guide apertures 48 (FIG. 5) therein. The opening of each of these guide apertures 48 is chamfered. The sectoral portions 20 are also drilled to form bulbous sections 49 (FIG. 5) of the trough 14 that are concentric with the guide apertures 48. The upper housing body 10 also includes two alignment apertures 50 for aligning the cover 6 over the RF cavity housing 4 before the cover 6 is secured to the RF cavity housing 4.

The cover 6 is a disc shaped block and has a planar undersurface 52. On a top surface 54 thereof is a recess 56 corresponding in shape and position to the RF cavity 19 in the RF cavity housing 4. This recess 56 includes troughs 58 which are wider than the troughs 14 of the RF cavity housing 4. The cover 6 also includes guide apertures 60 in the recess 56 that are aligned with the corresponding guide apertures 48 in the RF cavity housing 4. The cover 6 also includes screw apertures 62 that are aligned with the threaded apertures 47 in the RF cavity housing 4.

The RF assembly 2 further includes twelve plunger or contact kits 64. Each contact kit 64 includes an electrically conductive switch blade or reed 66, 68 and a pair of guide pins 70, each fixedly attached at one end thereof to the reed 66, 68. The contact kit 64 also includes a cap 72 that is fixedly attached to the other ends of the guide pins 70. The reed 66, 68 may be a short reed 66 or a long reed 68, each having a width in the range of 0.6 mm-1.6 mm. In the specific embodiment, the reed 66, 68 has a width of 1.10 mm. A contact kit 64 having a short reed 66 and another contact kit 64 having a long reed 68 are used in each trough 14 or channel 26. The contact kit 64 with the short reed 66 is actuated to connect the centre pin 46 of the RF connector 44 in the channel 26 to the terminating load card 74 in an open state of the channel 26. The contact kit 64 with the long reed 68 is actuated to connect the centre pin 46 of the RF connector 35 in the channel 26 to the centre pin 46 of the RF connector 35 in the central cavity 12 in a closed state of the channel 26. The reeds 66, 68 are constructed of gold plated beryllium copper which provides very good solderability, wear and RF qualities. The guide pins 70 are made of polytetrafluoroethylene (PTFE).

During assembly, two guide pins 70 are attached to the ends of each reed 66, 68. Each guide pin 70 is fixedly attached to the reed 66, 68 at a position offset from an end of the guide pin 70 to leave an end portion of the guide pin 70 of a sufficient length to serve as a guide within a guide aperture 48, for guiding the reed 66, 68 in straight up and down movement with respect to the floor 42 of the trough 14. The other ends of the guide pins 70 are inserted into the guide apertures 60 in the cover 6 from the undersurface 52 of the cover 6 so that they protrude into the recess 56 in the cover 6. A rectangular frame leaf spring 75 is placed in each trough 58 of the recess 56 with its pivoting point 76 resting on the recess floor. The leaf spring 75 straddles two adjacent contact kits 64 in a channel 26 to surround adjacent guide pins 70 of the two adjacent contact kits 64 as shown in FIGS. 6A and 6B. In this position, each shorter side of the rectangular frame leaf spring 75 is located in between the guide pins 70 of each contact kit 64. A cap 72 is then placed over the free ends of the guide pins 70 with the ends of the guide pins 70 inserted into corresponding holes in the cap 72. The ends of these guide pins 70 are secured to the cap 72 by heat-staking. In this manner, the twelve contact kits 64 are secured to the cover 6, each being moveable in a direction parallel to the axis of the cover 6.

The shorter edges of the leaf spring 75 sandwiched between the pair of caps 72 and the recess floor bias the caps 72 away from the recess floor so that the respective reeds 66, 68 are in a "unpushed" or non-actuated position where they do not electrically bridge the center pin 46 of the RF connector 35 in the trough 14 to either the centre pin 46 of the RF connector 35 in the central cavity 12 or the terminating load card 74. In this position, the reeds 66, 68 are forced, by the leaf spring 75, against the ceiling of the channel 26, and the top of the caps 72 is substantially flush with the top surface 54 of the cover 6.

Figure 3:
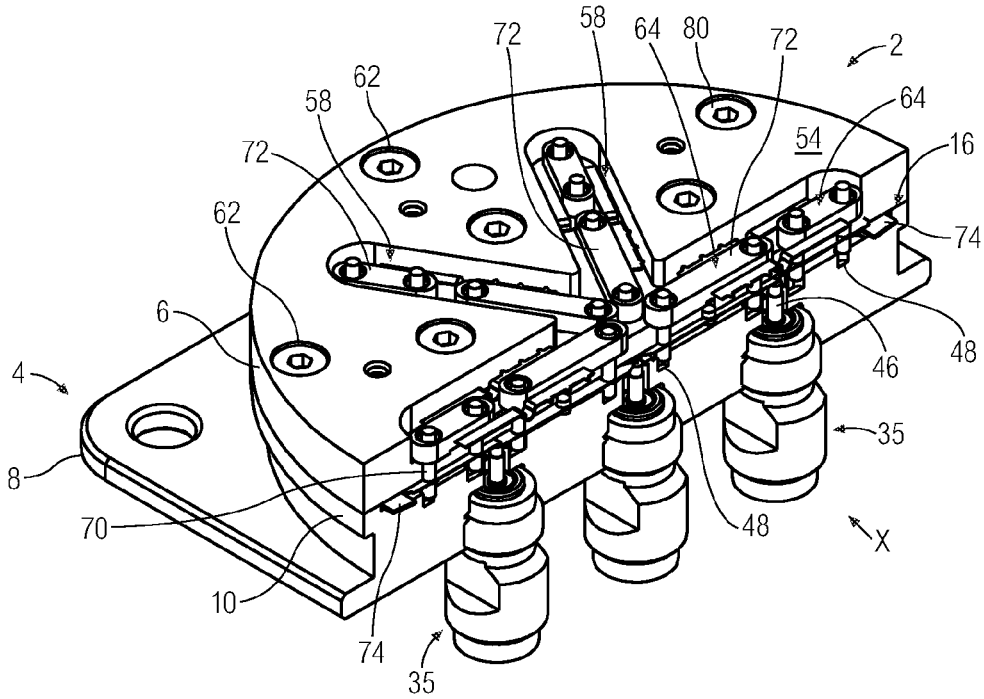
FIG. 3 is a sectional isometric drawing of the RF assembly in FIG. 2 with parts of the RF assembly shown assembled.

The cover 6 with the contact kits 64 assembled thereon is aligned over the RF cavity housing 4 with the aid of guide rods (not shown) inserted through the alignment apertures 50. In this manner the reed ends of the guide pins 70 are located in the respective guide apertures 48 in the RF cavity housing 4 to further guide the movement of the contact kits 64. Allen head cap screws 80 are used to secure the cover 6 to the RF cavity housing 4. FIGS. 3 & 4 show the assembled RF assembly 2.

After the RF assembly 2 has been assembled, the RF assembly 2 is attached to the drive assembly. The drive assembly includes a first solenoid 82 that is spaced apart from a second solenoid 84, a permanent magnet 86 interposed between the two solenoids 82, 84, a pair of dielectric pushrods 88, 90 and a magnetically permeable rocker actuator 92. A pushrod 88, 90 is inserted in the bore of each solenoid 82, 84 to be slideable therein along an axial direction of the solenoid 82, 84, with one end of it coming into contact with a cap 72 of the RF assembly 2 as shown in FIGS. 6A and 6B. External power and drive signals are supplied to the solenoids 82, 84 via the interface board and the sensor board assembly. When assembled in this manner, the magnetic field of the permanent magnet 86 attracts the rocker actuator 92 to pull one end of the rocker actuator 92 towards a corresponding solenoid 82, 84. FIG. 6A shows a first end of the rocker actuator 92 pulled towards the second solenoid 84. This attraction of the rocker actuator 92 causes the rocker actuator 92 to push the pushrod 90 and in turn the short reed 66, against the opposing force of the leaf spring 75, to electrically bridge the centre pin 46 of the RF connector 35 in the channel 26 to its terminating load card 74 as shown in FIG. 6A. The strength of the magnetic field of the permanent magnet 86 is sufficient to hold the rocker actuator 92 in this position. This position of the rocker actuator 92 corresponds to an open state of the channel 26 or port.

To close the channel 26 or port of the multiport switch, voltage is applied across the second solenoid 84 to allow an electric current to flow through the second solenoid 84. This electric current produces a magnetic field which cooperates with the magnetic fields of the permanent magnet 86 and the first solenoid 82 to cause the rocker actuator 92 to rotate about its pivoting axis so that the second end of the rocker actuator 92 is moved towards the first solenoid 82. This movement of the rocker actuator 92 pushes the pushrod 88 and in turn the long reed 68 to electrically bridge the centre pins 46 in the channel 26 and the central cavity 12 as shown in FIG. 6B. Once it is detected by the sensor board assembly that the rocker actuator 92 is in this position, the current flowing through the second solenoid 84 is terminated and the magnetic field of the permanent magnet 86 is again able to maintain the rocker actuator 92 in position. Similarly, current is passed though the first solenoid 82 momentarily to return the rocker actuator 92 to its position shown in FIG. 6A.

Advantageously, a multiport switch with the RF assembly 2 described above is able to operate at a frequency beyond 26.5 GHz.

Although the present invention is described as implemented in the above described embodiment, it is not to be construed to be limited as such. For example, the invention may be implemented in an embodiment with dimensions that differ from those given in the above description. As another example, the width of the trough 14 need not be reduced at the proximal end of the trough abutting the central cavity; instead the trough 14 may be of uniform width throughout the length of the trough, the desired operating frequency range being achieved solely with a reduced height at the proximal end. The height of the trough may also be reduced by including a protruding portion on a surface of the cover that abuts the RF cavity housing. This protruding portion meshes with the end of the trough to reduce the height of the channel thereat.

As another example, the invention may also be implemented in a multiport or microwave switch with a different number of ports than that in the above described embodiment. The invention may also be embodied in a microwave switch with only a single trough connected to a single cavity.

As yet another example, it should be noted that the drive mechanism is distinct from the RF assembly in a multiport switch. Therefore, the invention may be used in multiport switches using drive mechanisms other than that described above. The drive assembly described above where the ports are individually actuatable is known as a "random selection" type of drive. The RF assembly described above may also be used with a "sequential" type of drive. An example of such a drive is a mechanical rotary drive disclosed in U.S. Pat. No. 5,281,936 entitled "Microwave Switch". This mechanical rotary drive may be used to sequence through an angular travel to depress each of several contact kits one-by-one.

What is claimed is:

1. An RF assembly of a multiport switch, the RF assembly comprising:

an RF cavity housing having:

a common port defined by a cavity in a surface of the RF cavity housing; and at least another port defined by a trough in the surface of the RF cavity housing, the trough being connected to the cavity; and a cover for covering the cavity and the trough, the covered trough defining a channel connected at a proximal end to the cavity;

the distance between opposing surfaces of the RF cavity housing and the cover at the proximal end of the channel being smaller than the distance between opposing surfaces of the RF cavity housing and the cover at a portion of the channel immediately adjacent the proximal end.

2. An RF assembly according to claim 1, wherein the cover includes a protruding portion on the surface of the cover, the protruding portion meshing with the trough at the proximal end of the channel.

3. An RF assembly according to claim 1, wherein the width of the trough reduces at the proximal end of the trough towards the cavity.

4. An RF assembly according to claim 1, wherein the RF cavity housing includes a platform at the proximal end of the trough.

5. An RF assembly according to claim 4, wherein the width of the trough reduces at the proximal end of the trough towards the cavity.

6. An RF assembly according to claim 5, wherein the platform includes an opening defined therein, and wherein the trough extends to the edge of the opening in the platform.

7. An RF assembly according to claim 6, wherein the RF cavity housing includes a bore in abutment and axial alignment with the platform opening, wherein a platform portion defining the opening overhangs the bore.

8. An RF assembly according to claim 7, wherein the height of the platform is in the range of 0.05 mm-0.40 mm; and the distance between opposing surfaces of the RF cavity housing and the cover at the portion of the channel immediately adjacent the proximal end is in the range of 0.643 mm-1.643 mm.

9. An RF assembly according to claim 8, wherein the height of the platform is 0.225 mm; and the distance between opposing surfaces of the RF cavity housing and the cover at the portion of the channel adjacent the proximal end is 1.143 mm.

10. An RF assembly according to claim 9, wherein the width of the channel at the portion of the channel immediately adjacent the proximal end is 1.608 mm; and the width of the channel where the proximal end connects to the cavity is 0.837 mm; and the RF assembly further comprising:

a reed in the channel having a width of 1.10 mm; and an RF connector connected to each port of the RF assembly, the RF connector having a centre pin having a tip diameter of 0.915 mm.

11. A multiport switch having an RF assembly, the RF assembly comprising:

an RF cavity housing having:

a common port defined by a cavity in a surface of the RF cavity housing; and at least another port defined by a trough in the surface of the RF cavity housing, the trough being connected to the cavity; and a cover for covering the cavity and the trough, the covered trough defining a channel connected at a proximal end to the cavity;

the distance between opposing surfaces of the RF cavity housing and the cover at the proximal end of the channel being smaller than the distance between opposing surfaces of the RF cavity housing and the cover at a portion of the channel immediately adjacent the proximal end.

12. A multiport switch according to claim 11, wherein the cover includes a protruding portion on the surface of the cover, the protruding portion meshing with the trough at the proximal end of the channel.

13. A multiport switch according to claim 11, wherein the width of the trough reduces at the proximal end of the trough towards the cavity.

14. A multiport switch according to claim 11, wherein the housing includes a platform at the proximal end of the trough.

15. A multiport switch according to claim 14, wherein the width of the trough reduces at the proximal end of the trough towards the cavity.

16. A multiport switch according to claim 15, wherein the platform includes an opening defined therein, and wherein the trough extends to the edge of the opening in the platform.

17. A multiport switch according to claim 16, wherein the RF cavity housing includes a bore in abutment and axial alignment with the platform opening, wherein a platform portion defining the opening overhangs the bore.

18. A multiport switch according to claim 17, wherein the height of the platform is in the range of 0.05 mm-0.40 mm; and the distance between opposing surfaces of the RF cavity housing and the cover at the portion of the channel adjacent the proximal end is in the range of 0.643 mm-1.643 mm.

19. An RF assembly according to claim 18, wherein the height of the platform is 0.225 mm; and the distance between opposing surfaces of the RF cavity housing and the cover at the portion of the channel adjacent the proximal end is 1.143 mm.

20. An RF assembly according to claim 19, wherein the width of the channel at the portion of the channel immediately adjacent the proximal end is 1.608 mm; and the width of the channel where the proximal end connects to the cavity is 0.837 mm; and the RF assembly further comprising:

a reed in the channel having a width of 1.10 mm; and an RF connector connected to each port of the RF assembly, the RF connector having a centre pin having a tip diameter of 0.915 mm.

* * * * *